US012618344B2

(12) United States Patent
Gudesen et al.

(10) Patent No.: US 12,618,344 B2
(45) Date of Patent: May 5, 2026

(54) THERMAL ENERGY SYSTEM AND METHOD

(71) Applicant: Hans Gude Gudesen, Gamle Fredrikstad (NO)

(72) Inventors: Hans Gude Gudesen, Lucerne (CH); Per-Erik Nordal, Asker (NO)

(73) Assignee: Hans Gude Gudesen, Gamle Fredrikstad (NO)

( * ) Notice: Subject to any disclaimer, the term of this patent is extended or adjusted under 35 U.S.C. 154(b) by 0 days.

(21) Appl. No.: 18/832,924

(22) PCT Filed: Jan. 25, 2023

(86) PCT No.: PCT/NO2023/050021
§ 371 (c)(1),
(2) Date: Jul. 24, 2024

(87) PCT Pub. No.: WO2023/146414
PCT Pub. Date: Aug. 3, 2023

(65) Prior Publication Data

US 2025/0101889 A1 Mar. 27, 2025

(30) Foreign Application Priority Data

Jan. 28, 2022 (NO) ..... 20220144

(51) Int. Cl.
*F01K 27/00* (2006.01)

(52) U.S. Cl.
CPC ..... *F01K 27/005* (2013.01)

(58) Field of Classification Search
CPC ..... F01K 27/005
See application file for complete search history.

(56) References Cited

U.S. PATENT DOCUMENTS

| | | | | |
|---|---|---|---|---|
| 4,030,303 | A | 6/1977 | Kraus | |
| 4,450,689 | A | 5/1984 | Moe | |
| 2001/0054289 | A1 | 12/2001 | Cover | |
| 2009/0288410 | A1 | 11/2009 | Wolter | |
| 2011/0000212 | A1* | 1/2011 | Wolter | F01K 27/005 60/645 |

(Continued)

FOREIGN PATENT DOCUMENTS

| | | | |
|---|---|---|---|
| CN | 112377378 | A | 2/2021 |
| DE | 2943686 | A1 | 7/1981 |
| DE | 19506317 | A1 | 9/1995 |

(Continued)

OTHER PUBLICATIONS

English language Abstract of CN 112377378 A (Feb. 19, 2021).

(Continued)

*Primary Examiner* — Shafiq Mian
(74) *Attorney, Agent, or Firm* — Hershkovitz & Associates, PLLC; Abe Hershkovitz

(57) ABSTRACT

A thermal energy method for converting thermal to mechanical energy is disclosed. The method comprises circulating liquid and vapor phases of a working fluid in a closed loop comprising a recipient arranged at a lower part and a tube system comprising a rising part, a condenser section of a descending part and a hydrostatic pressure section of a descending part. A corresponding system is also disclosed.

17 Claims, 3 Drawing Sheets

(56) References Cited

U.S. PATENT DOCUMENTS

2019/0211968 A1* 7/2019 Serrano ..... F01K 13/003

FOREIGN PATENT DOCUMENTS

| | | | |
|---|---|---|---|
| DE | 10039989 | A1 | 3/2002 |
| FR | 2397741 | A1 | 2/1979 |
| GR | 1009505 | B | 4/2019 |
| WO | WO 2007113062 | A1 | 10/2007 |
| WO | WO 2009077275 | A2 | 6/2009 |
| WO | WO 2015016693 | A1 | 2/2015 |
| WO | WO 2017/175092 | A1 | 10/2017 |

OTHER PUBLICATIONS

English language Abstract of DE 10039989 A1 (Mar. 14, 2002).
English language Abstract of DE 19506317 A1 (Sep. 21, 1995).
English language Abstract of DE 2943686 A1 (Jul. 2, 1981).
English language Abstract of FR 2397741 A1 (Feb. 9, 1979).
English language Abstract of GR 1009505 B (Apr. 5, 2019).
"Organic Rankine cycle", Wikipedia, 2024, https://en.wikipedia.org/wiki/Organic_Rankine_cycle.
International Search Report in International Application No. PCT/NO2023/050021, mailed on Jun. 20, 2023.
Written Opinion of the International Searching Authority in International Application No. PCT/NO2023/050021, mailed on Jun. 20, 2023.
Norwegian Search Report in related Norwegian Patent Application No. 20220144, dated Aug. 26, 2022.

* cited by examiner

Figs. 3a - d

THERMAL ENERGY SYSTEM AND METHOD

FIELD OF THE INVENTION

The present invention relates to a method for converting thermal energy into mechanical energy and a corresponding system.

BACKGROUND OF THE INVENTION

Engines that are able to convert thermal energy into mechanical energy have played a central role since the dawn of the industrial revolution, and novel concepts in this field are still emerging. One important trend of particular relevance in the present context is towards operation with low temperature thermal sources. One example is the Organic Rankine cycle (ORC) (https://en.wikipedia.org/wiki/Organic_Rankine_cycle) where working fluids other than water, e.g. n-pentane and toluene, are employed with volatility characteristics that permit operation with low grade heat sources, typically in the range 100° C.-200° C. However, at the lower part of this temperature range and in particular below 70° C. there are at present no generally applicable concepts that can deliver adequate commercially relevant performance. Unfortunately, this is the temperature range where there exist vast untapped thermal energy resources around the globe. There is therefore a pressing need for concepts that can employ these energy reserves to generate mechanical power and electricity.

SUMMARY OF THE INVENTION

A first aspect of the invention is a thermal energy method for converting thermal to mechanical energy comprising circulating liquid and vapor phases of a working fluid in a closed loop comprising a recipient arranged at a lower part and a tube system comprising a rising part, a descending part with a condenser section and with a hydrostatic pressure section. The circulating comprises heating the working fluid in the recipient providing working vapor, i.e. vaporized working fluid, and compensating for thermal energy loss due to vaporization, condensing the working vapor in the condenser section providing condensed liquid phase working fluid, and setting up a pressure differential contributing to lifting the working vapor in the rising part, collecting the condensed working fluid in the hydrostatic pressure section providing a hydrostatic pressure head, extracting mechanical energy based on the hydrostatic pressure head, and returning the collected condensed working fluid to the recipient.

Optionally, the heating of the working fluid in the recipient is arranged for maintaining a set temperature of the working fluid, and, further optionally, the set temperature is less than 50° C.

Optionally, the method comprises heating the vaporized working fluid in the rising part avoiding condensation.

Optionally, the condensing comprises exposing the working vapor to cooling surfaces in the condenser section, where the temperature of the cooling surfaces is below local dew point.

Optionally, the method comprises initially filling the closed loop with one or more non-condensing gases at a set pressure prior to introducing the working fluid.

Optionally, the method comprises initially purging non-condensing gases from the closed loop, and, further optionally, the initial purging comprises evacuation prior to introducing the working fluid.

Optionally, the method further comprises generating electrical energy by a turbine or a piston engine arranged to be driven by the hydrostatic pressure head.

Optionally, the working fluid comprises one or more of the following, alone or in a mixture: water, carbon dioxide, ammonia, a Freon compound, a hydrocarbon, a halogenated hydrocarbon, tetrafluoroethane, and pentafluoropropane.

Optionally, the recipient constitutes a variable volume within a fixed enclosing volume, and where the extracting mechanical energy contributes to expanding the variable volume, where the method, further optionally, comprises the following steps:

- an accumulation step comprising the steps of heating, transporting and collecting, where the step of collecting comprises temporarily keeping the condensed working fluid in the hydrostatic pressure section, contributing to reducing the volume of, thus shrinking, the recipient;
- a hydropower generation step comprising generating electrical energy by passing water through a turbine and into the enclosing volume vacated by the shrinking of the recipient, where hydrostatic pressure in the water exceeds vapor pressure in the closed loop, and provides pressure head for the turbine; and
- a regeneration step where the steps of extracting mechanical energy and returning comprise allowing the working liquid in the hydrostatic pressure section expanding the variable recipient volume and forcing liquid out of the enclosing volume.

A further aspect of the invention is a thermal energy system comprising means for performing the thermal energy method described above.

Optionally, the system comprises:

- a closed loop comprising a recipient arranged at the lower part and a tube system comprising a rising part, and a descending part with a condenser section and with a hydrostatic pressure section;
- means for heating the working fluid in the recipient providing working vapor and compensating for thermal energy loss due to vaporization;
- means for condensing the working vapor in the condenser section providing condensed liquid phase working fluid, and setting up a pressure differential contributing to lifting the working vapor in the rising part;
- means for collecting the condensed working fluid in the hydrostatic pressure section providing a hydrostatic pressure head;
- means for extracting mechanical energy based on the hydrostatic pressure head; and
- means for returning the collected condensed working fluid to the recipient.

Optionally, the system comprises means for heating the vaporized working fluid in the rising part avoiding condensation.

Optionally, the means for extracting mechanical energy comprises a turbine or a piston engine.

Optionally, the recipient constitutes a variable volume within a fixed enclosing volume, where, further optionally, the recipient volume comprises an expandable bladder, bellows or a piston.

Optionally, the system comprises:

- means for temporarily keeping the condensed working fluid in the hydrostatic pressure section, contributing to reducing the volume of, thus shrinking, the recipient;
- a turbine arranged for generating electrical energy by allowing water passing through the turbine and into the enclosing volume vacated by the shrinking of the recipient, where hydrostatic pressure in the water exceeds vapor pressure in the closed loop, and provides pressure head for the turbine; and means for controllably allowing the working liquid in the hydrostatic pressure section expanding the recipient volume and forcing water out of the enclosing volume.

DESCRIPTION OF THE FIGURES

The above and other features of the invention are set forth with particularity in the appended claims and together with advantages thereof will become clearer from consideration of exemplary embodiments of the invention given with reference to the accompanying drawings.

Embodiments of the present invention will now be described, by way of example only, with reference to the following figures, wherein.

LIST OF REFERENCE NUMBERS IN THE FIGURES

Figure 1:
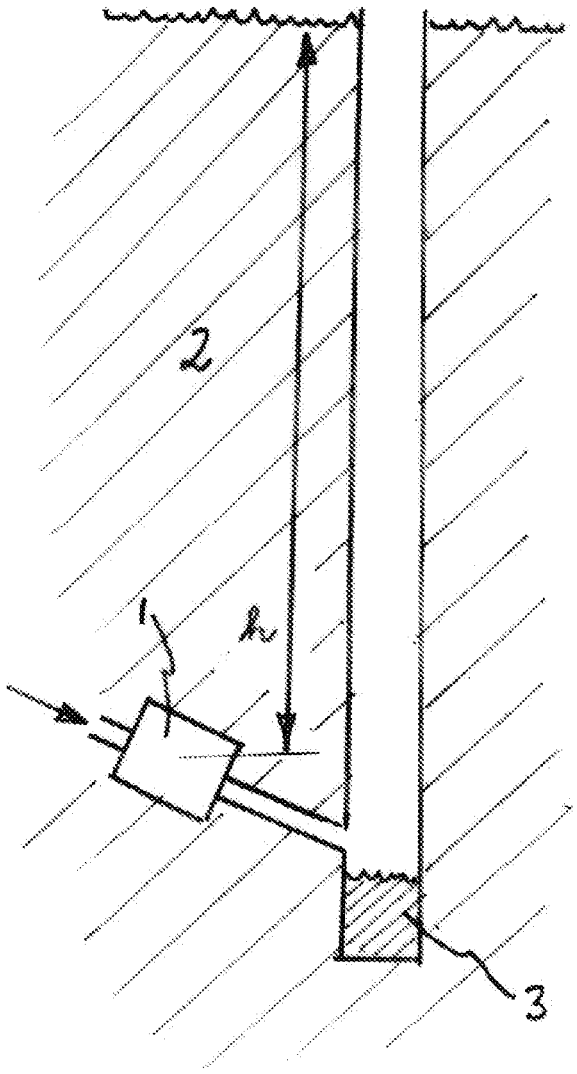
FIG. 1 illustrates an example of prior art.

The following reference numbers refer to the drawings:

Number Designation

1 Turbine
2 Body of water
3 Recipient
4 Column
5 Heat exchange elements
6 Dispersion devices
7 Riser tube
8 Top point
9 Condenser region
10 Collection tube
11 Cooling coil
12 Column top
13 Heating elements
14 Tailrace
15 Intake tube
16 Valve
17 Fixed enclosing volume
18 Valve
19 Recipient with variable volume
20 Working liquid
21 Vertical channel
22 Vertical channel
23 Valve
24 Valve
25 Condenser
26 Heating coil
27 Heating coil
28 Channel top point
29 Cooling coil

DESCRIPTION OF PREFERRED EMBODIMENTS OF THE INVENTION

The problem which is addressed by the present invention can be illustrated as follows: A hydroelectric turbine/generator system operates in a location where spent water from the turbine is collected in a limited recipient volume. When the recipient is full, the turbine stops. In many cases, the only available alternative for regenerating recipient space is to add energy to lift the water in the recipient to a higher level. An example of such a situation is shown in FIG. 1, where the turbine (1) is positioned in a body of water (2) at a depth h below the water surface. Spent water from the turbine is collected in a recipient (3), in this case an open column extending to the water surface. As water flows into the recipient, the water level rises in the column and a back pressure develops against the turbine until the recipient water level matches that of the body of water, and the turbine stops. In order to obtain a sustainable operation, the water from the turbine must be evacuated from the recipient, either cyclically or in a continuous process. This is an object of the present invention, which is described below.

The basic idea of the present invention is to restore potential energy in the gravity field for spent working fluid, i.e. working fluid that has yielded potential energy by driving a mechanical energy extraction device (turbine, pump, etc). This is achieved by employing a phase transition protocol as follows: The spent working fluid is contained in the lower part of a closed loop where it is first converted to the vapor phase. A condenser in the upper part of the closed loop sets up a pressure differential in the vapor volume inside the closed loop, causing the vapor to be transported to a higher level in the gravity field where it is converted back to the liquid phase, ready for a new power cycle through the mechanical energy extraction device.

Figure 2:
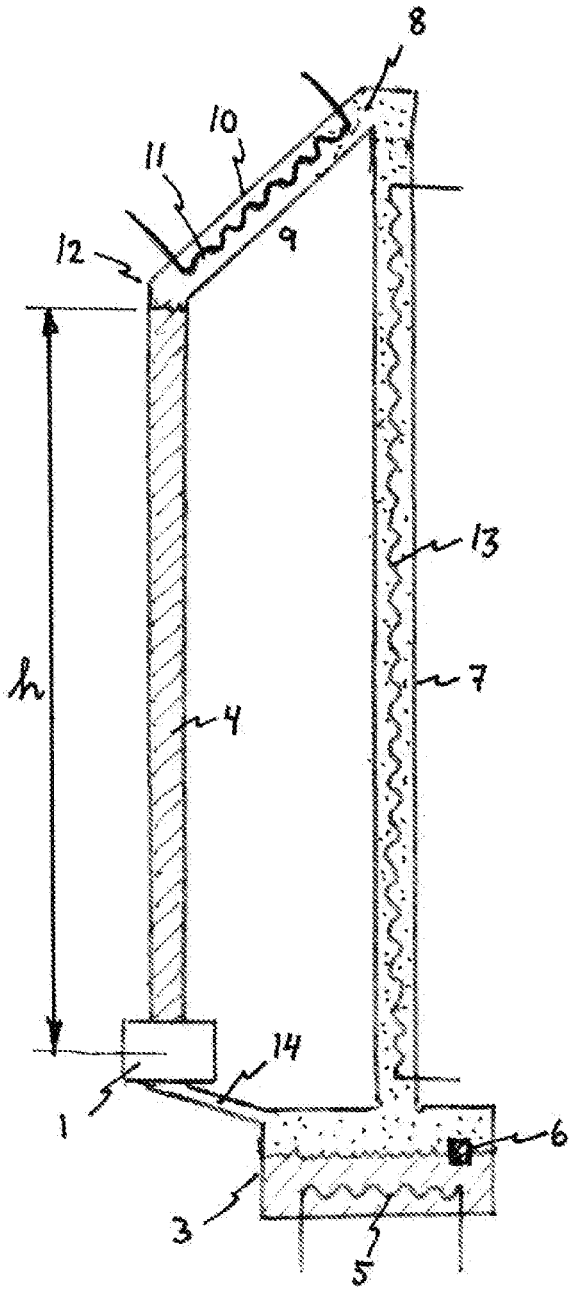
FIG. 2 shows an embodiment where a working fluid drives a turbine directly.

FIG. 2 shows a preferred embodiment according to the present invention. The turbine (1) is driven by a column (4) of working fluid, of head h. Spent working fluid from the turbine is collected in the recipient (3). Heat exchange elements (5) and dispersion devices (6) cause the working fluid in the recipient to evaporate, and the vapor is transported vertically in a riser tube (7). The vapor is kept from condensing in the riser tube by maintaining an elevated temperature in the tube walls and/or by heating elements (13) disposed inside the tube. At top point (8) vapor from the riser tube enters a condenser region (9). In FIG. 2 the latter is shown as a descending collection tube (10) with cold condensing surfaces on a cooling coil (11) in contact with the vapor coming from the riser tube (7). Condensed liquid in the collection tube (10) is transported by gravity to column top (12) where it is delivered to the column (4) providing the hydrostatic pressure head h to the turbine (1).

The working fluid circulates in a closed loop where the working fluid is cyclically vaporized and condensed. In a steady state, the amount of fluid in the different aggregation states is constant, controlled by the amount of thermal energy transported into and out from the system. In order to maximize turbine power, the vapor pressure at the tailrace (14) should be minimized. Also, a low pressure above the liquid in the recipient (3) shall promote evaporation. However, these factors shall be dependent on the phase characteristics of the working fluid to be used and the temperatures available from the evaporation heat source and the condensation cooling system. This can be illustrated by the following examples:

Example 1: Water as working fluid, with buffer gas at 1 bar. Referring to FIG. 2, the system starts out with all vapor spaces, defined here as the space above the liquid in recipient (3) and in the riser tube (7) and collection tube (10), filled with dry air as a buffer gas at pressure 1 bar. Heating and maintaining the water in the recipient at 100 C shall cause water vapor to be generated which migrates into the riser tube (7) and collection tube (10). In the absence of a condensing action in the condenser region (9) the total pressure in the vapor spaces would increase due to the added partial pressure from the water vapor. At equilibrium the net transfer rate from liquid to vapor in the recipient would be zero. When the condenser is started, it presents surfaces to the vapor that are at lower temperatures than the local dew point, precipitating condensed water into the column (4) and lowering the local vapor pressure. This sets up a pressure gradient in the vapor spaces causing vapor to be transported from the recipient and into the riser tube (7) and further into the condenser region (9). Since the recipient is maintained at a set temperature T, the lowered pressure will then cause more liquid to evaporate, replenishing the vapor in the vapor spaces and causing a net flux of vapor to transfer from the recipient into the riser tube (7).

Example 2: Only working fluid, without buffer gas. In Example 1, the buffer gas pressure defines the lower floor of the boiling temperature T for water in the recipient (3), and the water vapor diffuses through the air in the vapor spaces, which shall slow down the overall process of transferring liquid from the recipient (3) and into the column (4). In the present example, the system in FIG. 2 shall be run through an initiation process before it is put into operation, where non-condensing gases, e.g. air are purged from the system. This may be achieved by simple evacuation prior to introducing the working fluid, where the working fluid flashes into vapor, building up the vapor pressure in the vapor spaces. In the absence of a condensing action in the vapor spaces the vapor pressure ultimately would reach a point where the vapor is in equilibrium with the liquid in the recipient (3), and where the saturation vapor pressure in the system is defined by the temperature in the recipient. Again, when the condenser is started, it presents surfaces to the vapor that are at lower temperatures than the dew point, precipitating liquid working fluid and lowering the local vapor pressure. This sets up a pressure gradient in the vapor spaces causing vapor to be transported from the recipient and into the riser tube (7) and further into the condenser region (9). Since the recipient is maintained at a set temperature T, the lowered pressure will then cause more liquid to evaporate, replenishing the vapor in the vapor spaces and causing a net flux of vapor to transfer from the recipient into the riser tube (7). A concrete example: Assume that the working fluid is carbon dioxide and that the recipient temperature is 15 C. The liquid/gas equilibrium pressure at this temperature is 5063 kPa, i.e. 50.63 bar. Since all surfaces in the vapor spaces are assumed to be maintained at 15 C or above, the vapor spaces shall be filled with $CO_2$ vapor at this pressure and the net transport of $CO_2$ between the liquid and gas phases is zero. When the condenser is activated, it shall present surfaces at temperatures below the dewpoint of 15 C against the $CO_2$ vapor, causing precipitation of liquid $CO_2$. This lowers the vapor pressure in the vapor spaces, including the liquid/gas interface in the recipient, causing additional $CO_2$ to evaporate. The speed at which condensation occurs depends on a number of factors, where the condensing surface temperature plays an important role. Thus, at a temperature of 5 C the liquid/vapor equilibrium pressure for $CO_2$ is 3953 kPa, i.e. 1110 kPa lower than the evaporation pressure in the recipient.

The system in FIG. 2 converts thermal energy to electrical energy at a very low efficiency. As an example, if the working fluid is water circulating at a rate of 1 $m^3s^{-1}$ and acting through a head h=200 m, one has:

Evaporation thermal power (water 100 C, 1 bar):

$$P_{Heat} = 2258\,\mathrm{kJ\,kg^{-1}} \times 1000\,\mathrm{kg\,s^{-1}} = 2{,}26\,\mathrm{GW} \quad \text{Eq. (1)}$$

Electrical power:

$$P_{Electric} = 1000\,\mathrm{kg\,m^{-3}} \times 9{,}81\,\mathrm{m\,s^{-2}} \times 200\,\mathrm{m} \times 1\,\mathrm{m^3s^{-1}} = 1{,}96\,\mathrm{MW} \quad \text{Eq. (2)}$$

Thus, the efficiency is in the vicinity of $10^{-3}$. Even if recuperation of thermal energy is included in the condenser, the overall efficiency shall remain very low. However, by selecting a working fluid with suitable phase transition properties, the system may provide novel opportunities for energy extraction from heat sources that can deliver large amounts of thermal energy at low to moderate temperatures.

FIGS. 3*a-d* illustrate another preferred embodiment according to the present invention. In this case there are two types of fluids involved, in different parts of the system, and the overall energy production process involves a series of steps that are repeated cyclically. In this example, the system is located with a turbine (1) at depth h in a body of water (2). The turbine can draw water from the body of water via an intake tube (15) and can deliver spent water via a valve (16) into a fixed enclosing volume (17). Another valve (18) controls water flow out of the fixed enclosing volume (17) into the surrounding body of water (2). A variable part of the volume in the fixed enclosing volume is taken up by an expandable bladder (19), e.g. in the form of a balloon or concertina structure. The bladder is filled with thermal working liquid (20) and its vapor and communicates with two vertical channels (21), (22) via valves (23), (24). The vertical channels are connected at the top by a slanting channel which constitutes the condenser (25). The system includes heating coils (26), (27) and a cooling coil (29).

Figure 3A:
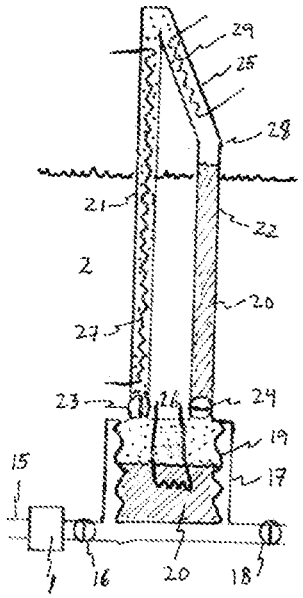
FIG. 3 shows an embodiment where a working fluid drives a turbine indirectly.

As shown in FIG. 3*a* the sequence starts with an accumulation step: The valves (16), (18) and (24) are closed and (23) is open, the heating coils (26), (27) and the cooling coil (29) are activated and the bladder (19) is fully extended. The thermal working liquid (20) vaporizes and the vapor rises in the channel (21) before it enters the condenser (25). Condensed thermal working liquid is collected and drops into the channel (22) at the top point (28). This process is kept running for a time sufficient to cause a substantial part of the thermal working liquid in the bladder to vaporize and transfer into channel (22).

Figure 3B:
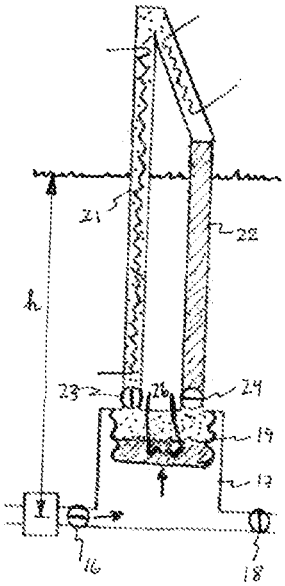

The next step in the sequence is the hydropower generation step which is illustrated in FIG. 3*b*: It may follow or partly overlap the accumulation step. The valves (16), (23) are now open and (18), (24) are closed. Thermal working liquid continues to vaporize and transfer into the channel (21). At the same time, hydrostatic pressure in the surrounding water, which exceeds the vapor pressure in the channel (21), provides a pressure head for the turbine (1) to produce power, and water that has passed through the turbine fills up the volume in the fixed enclosing volume (17) vacated by the shrinking bladder (19).

Figure 3C:
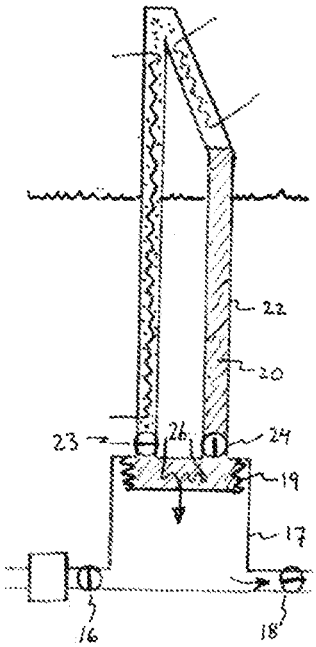
Figure 3D:
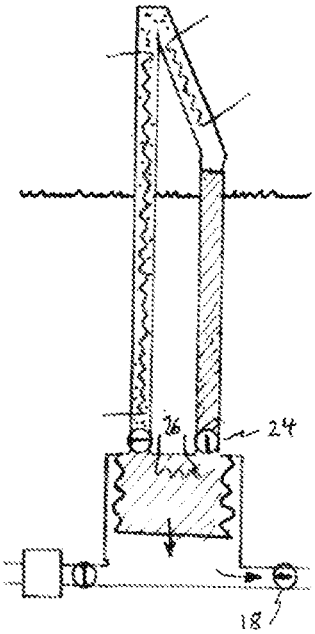

FIGS. 3*c,d* illustrate two phases of the regeneration step: The valves (16), (23) are now closed and (18), (24) are open. Channel (22) contains thermal working liquid (20) representing a hydrostatic pressure head at the recipient (17) exceeding that of the surrounding water. This causes the bladder (19) to expand, forcing water from the recipient to exit through the valve (18) into the surrounding volume of water. When the bladder is fully extended, valves (18), (24) close and the system reverts to the system shown in FIG. 3*a*, ready for a new cycle.

A person skilled in the art shall recognize that there exist a number of equivalent techniques for performing the operations described in connection with FIGS. 3*a-d*, where the working fluid is contained within a variable but closed volume. As an example of this, the expandable bladder in FIGS. 3*a-d* may be substituted by a piston which moves within a cylinder which opens upon the channel (21) at one end and the volume in the fixed enclosing volume (17) at the other end.

The invention claimed is:

1. A thermal energy method for converting thermal to mechanical energy, the method comprising:

circulating liquid and vapor phases of a working fluid in a closed loop comprising a recipient constituting a variable volume within a fixed enclosing volume, arranged at a lower part and a tube system comprising a rising part, a descending part with a condenser section and with a hydrostatic pressure section, wherein the circulating comprises:

heating the working fluid in the recipient providing working vapor, and compensating for thermal energy loss due to vaporization;

condensing the working vapor in the condenser section providing condensed liquid phase working fluid, and setting up a pressure differential contributing to lifting the working vapor in the rising part;

collecting the condensed working fluid in the hydrostatic pressure section providing a hydrostatic pressure head;

extracting mechanical energy based on the hydrostatic pressure head wherein extracting mechanical energy contributes to expanding the variable volume; and returning the collected condensed working fluid to the recipient.

2. The thermal energy method according to claim 1, wherein the heating of the working fluid in the recipient is arranged for maintaining a set temperature of the working fluid.

3. The thermal energy method according to claim 2, wherein the set temperature is less than 50° C.

4. The thermal energy method according to claim 1, further comprising heating the working vapor in the rising part avoiding condensation.

5. The thermal energy method according to claim 1, wherein the condensing comprises exposing the working vapor to cooling surfaces in the condenser section, wherein the temperature of the cooling surfaces is below local dew point.

6. The thermal energy method according to claim 1, comprising initially filling the closed loop with one or more non-condensing gases at a set pressure prior to introducing the working fluid.

7. The thermal energy method according to claim 1, comprising:

initially purging non-condensing gases from the closed loop.

8. The thermal energy method according to claim 7, wherein the initial purging comprises evacuation, prior to introducing the working fluid.

9. The thermal energy method according to claim 1, wherein the method further comprises:

generating electrical energy by one of, a turbine or a piston engine arranged to be driven by the hydrostatic pressure head.

10. The thermal energy method according to claim 1, wherein the working fluid comprises at least one of the following, alone or in a mixture: water, carbon dioxide, ammonia, a Freon compound, a hydrocarbon, a halogenated hydrocarbon, tetrafluoroethane, and pentafluoropropane.

11. The thermal energy method according to claim 1, comprising the following:

accumulating, including, heating, transporting, and collecting, wherein collecting comprises temporarily keeping the condensed working fluid in the hydrostatic pressure section, contributing to reducing the volume of, thus shrinking, the recipient;

a hydropower generating including generating electrical energy by passing water through a turbine and into the enclosing volume vacated by the shrinking of the recipient, wherein hydrostatic pressure in the water exceeds vapor pressure in the closed loop, and provides pressure head for the turbine; and regenerating, wherein extracting mechanical energy and returning comprise allowing the working liquid in the hydrostatic pressure section expanding the variable recipient volume and forcing liquid out of the enclosing volume.

12. A thermal energy system comprising:

a closed loop comprising a recipient constituting a variable volume within a fixed enclosing volume arranged at a lower part and a tube system comprising a rising part, and a descending part with a condenser section and with a hydrostatic pressure section;

means for heating a working fluid in the recipient providing working vapor and compensating for thermal energy loss due to vaporization;

means for condensing the working vapor in the condenser section providing condensed liquid phase working fluid, and setting up a pressure differential contributing to lifting the working vapor in the rising part;

means for collecting condensed working fluid in the hydrostatic pressure section providing a hydrostatic pressure head;

means for extracting mechanical energy based on the hydrostatic pressure head wherein extracting mechanical energy contributes to expanding the variable volume; and means for returning the collected condensed working fluid to the recipient.

13. The thermal system according to claim 12, further comprising means for heating the working vapor in the rising part avoiding condensation.

14. The thermal energy system according to claim 12, wherein the means for extracting mechanical energy comprises one of, a turbine or a piston engine.

15. The thermal energy system according to claim 12, wherein the recipient volume comprises one of, an expandable bladder, bellows or a piston.

16. The thermal energy system according to claim 12, wherein the system comprises:

means for temporarily keeping the condensed working fluid in the hydrostatic pressure section, contributing to reducing the volume of, thus shrinking, the recipient;

a turbine arranged for generating electrical energy by allowing water passing through the turbine and into the enclosing volume vacated by the shrinking of the recipient, wherein hydrostatic pressure in the water exceeds vapor pressure in the closed loop, and provides pressure head for the turbine; and means for controllably allowing the working liquid in the hydrostatic pressure section expanding the recipient volume and forcing water out of the enclosing volume.

17. The thermal energy method according to claim 2, further comprising heating the working vapor in the rising part avoiding condensation.

* * * * *